US005332039A

United States Patent [19]

Primeaux et al.

[11] Patent Number: 5,332,039

[45] Date of Patent: Jul. 26, 1994

[54] SELECTIVE DUAL GRAVEL PACK

[75] Inventors: Kurt P. Primeaux, Mandeville; John M. Guidry, Luling, both of La.

[73] Assignee: Texaco Inc., White Plains, N.Y.

[21] Appl. No.: 986,205

[22] Filed: Dec. 7, 1992

[51] Int. Cl.[5] ..... E21B 43/00

[52] U.S. Cl. ..... 166/278; 166/51

[58] Field of Search ..... 166/51, 278, 297

[56] References Cited

U.S. PATENT DOCUMENTS 4,401,158 8/1983 Spencer et al. ..... 166/51

4,606,408 8/1986 Zunkel et al. ..... 166/51 X 4,627,488 12/1986 Szarka ..... 166/51

4,733,723 3/1988 Callegari, Sr. ..... 166/51

*Primary Examiner*—Thuy M. Bui

*Attorney, Agent, or Firm*—James L. Bailey; Kenneth R. Priem; Russell J. Egan

[57] ABSTRACT

A method and apparatus allowing sequential production from layers in a well uses a pair of vertically spaced production assemblies formed by packer seal assembly above a respective screen assembly. The production assemblies are spaced on a production pipe string to be substantially aligned with zones to be produced. Isolation tubing allows the lower zone to be produced to depletion when the tubing is then plugged, perforated and the upper zone produced.

5 Claims, 1 Drawing Sheet

SELECTIVE DUAL GRAVEL PACK

BACKGROUND OF THE INVENTION

1. Field Of The Invention

The present invention relates to a method and apparatus providing selective dual gravel packing of a well to enable production to depletion from a lower strata and then switching to an upper strata for production to depletion.

2. The Prior Art

It is well known that a single yell bore will penetrate a plurality of vertically spaced production zones. In order to effectively and efficiently remove the hydrocarbons from the respective producing zones, it is preferable to work a single zone at a time in order to be able to ascertain the effectiveness of any secondary or enhanced oil recovery procedures being used. Heretofore this has been accomplished by using a sliding sleeve gravel pack. However such sleeves are subject to corrosion problems which can inhibit sliding thereby making the tool inoperative. Thus production from an additional zone can be prevented simply because the tool in the wellbore blocks access to that layer. It is, of course, possible to remove the sliding sleeve tool and replace it with another. However, this requires the expenditure of a substantial amount of time and expense.

The present invention has as an object to overcome the above mentioned corrosion problem by providing a dual gravel packing tool and method for using the tool to selectively produce oil from individual zones.

SUMMARY OF THE INVENTION

The present invention provides a pair of vertically spaced production assemblies each having a gravel pack assembly and associated seal assembly. The production assemblies are spaced to be substantially aligned with respective production zones of the well defining upper and lower zones. A pre-perforated pipe extends into the lower zone and an unperforated pipe extends into the upper zone. Initially the lower zone is produced until depletion, then a plug is set in the blank pipe between the two zones and the upper pipe is perforated to allow production of the upper zone.

BRIEF DESCRIPTION OF THE DRAWINGS

The present invention will now be described, by way of example, with reference to the accompanying drawing in which.

DETAILED DESCRIPTION OF THE PREFERRED EMBODIMENT

Figure 1:
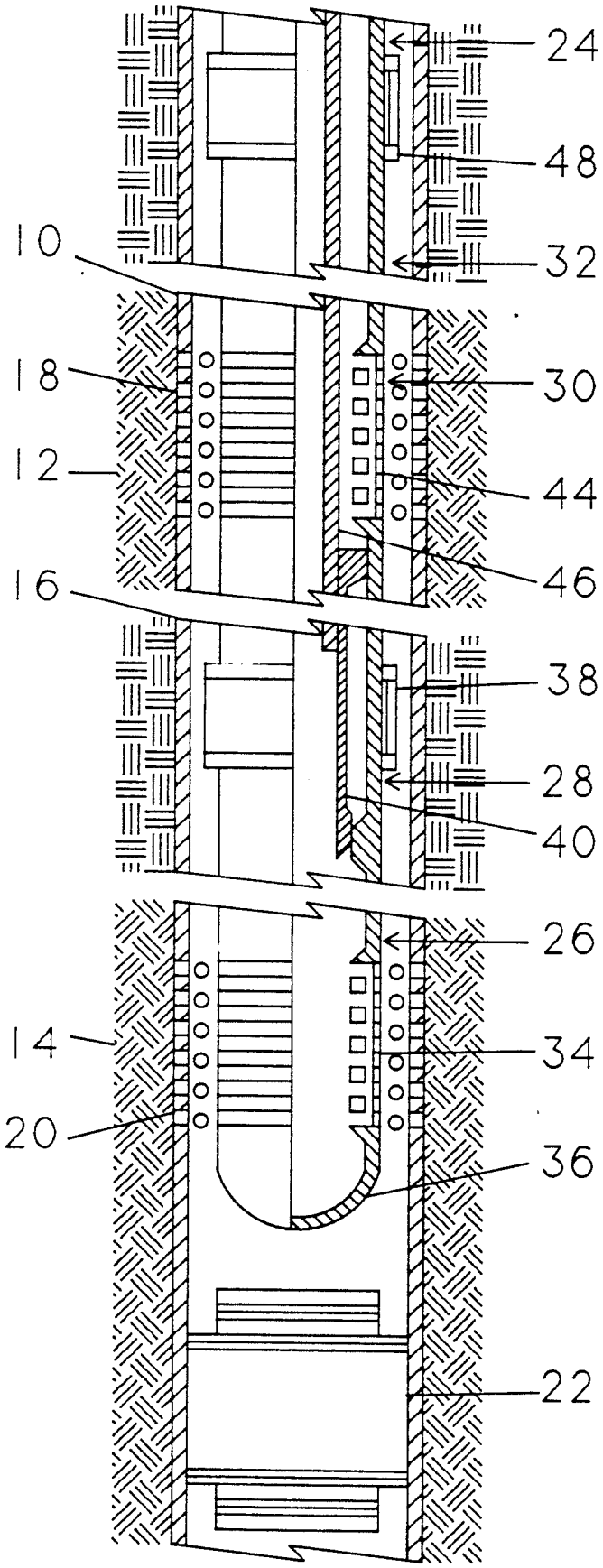
FIG. 1 is a side elevation, partly in section and foreshortened, showing only the essential features of the present invention.

FIG. 1 is a partial vertical section through a typical well bore 10 which has penetrated vertically spaced producing strata or layers 12, 14. A casing 16 has been inserted in the well and perforated at 18 and 20, which generally align with the producing layers 12 and 14, respectively. The bottom of the well is closed off by a known cement retainer 22 which has been set below the lower perforated portion 20 of the casing 16.

The subject invention 24 has been shown in four segments, 26, 28, 30, 32, reading from the bottom up and in their effective order of use. Each of these segments are connected by conventional tubing (not shown) which generally include standard devices associated with such a production string including, but not limited to, safety shear subs and centering devices (neither of which has been shown).

The lowest segment 26 is a first production screen assembly 34 with its lower end capped off by a bull plug 36. The next segment 28 has a first or lower packer assembly 38 and an interior seal assembly 40. The third segment 30 includes a second or upper production screen assembly 44 and initially unperforated isolation tubing 46. The fourth segment 32 includes a second or upper packer assembly 48.

The casing 16 will be initially perforated in the regions of the two producing layers and those layers and gravel packed by known means which need not be described here in detail since this is well known in the art. The hydrocarbons from the lower zone 14 will travel out of the sand, through gravel pack screen 34 and up the inner blank pipe 46. The lower layer 14 will be produced until depletion. Then, without use of a rig, the lower layer 14 is isolated by setting a plug (not shown) in the isolation tubing 46. The isolation tubing 46 is then perforated in the vicinity of the upper zone 12 and perforations 18 and the upper zone 12 allowed to produce. The perforation charges are designed to only perforate the inner blank pipe 46, the casing 16 having been perforated previously. Then the upper zone 18 will be produced with the flow traveling out of the sand, through the gravel pack screen 44 and the annulus between the now perforated inner pipe 46 and outer tubing 32, through the perforated inner blank pipe 46 and up the tubing to the surface.

The present invention may be subject to many modifications and changes which will be apparent to those skilled in the art. The above discussed embodiment is therefore intended in all respects as being illustrative and not restrictive of the scope of the invention as defined by the appended claims.

We claim:

1. A method for sequentially producing vertically spaced hydrocarbon containing zones penetrated by a single well bore comprising:

providing upper and lower production assemblies;

providing isolation tubing extending through said upper production assembly;

setting said upper and lower production assemblies in a well substantially aligned with upper and lower zones to be produced;

producing the lower zone to depletion;

setting a plug in said isolation tubing between said zones;

perforating said tubing in said upper zone; and producing said upper zone to depletion.

2. A method according to claim 1 further comprising the step of;

providing each said upper and lower production assembly with a gravel pack screen assembly substantially aligned with the zone to be produced and a sealing assembly above each said packer screen assembly and respective zone.

3. An production pipe string for sequentially producing vertically spaced hydrocarbon containing zones penetrated by a single well bore comprising:

an upper production assembly;

a lower production assembly; and isolation tubing extending through said upper production assembly to said lower production assembly whereby the zone opposite the lower production assembly is produced to depletion and sealed off, said isolation tubing is then perforated within the upper production assembly and the second zone produced to depletion through said upper production assembly. isolation tubing is then perforated and the second zone produced to depletion through said upper production assembly.

4. A production pipe string according to claim 3 wherein each said production assembly comprises:

a gravel pack screen assembly; and a sealing assembly located above said gravel pack screen assembly.

5. A production pipe string according to claim 3 further comprising sufficient production pipe to place each said production assembly substantially opposite the respective zone to be produced.

* * * * *

UNITED STATES PATENT AND TRADEMARK OFFICE

CERTIFICATE OF CORRECTION

PATENT NO. : 5,332,039

DATED : July 26, 1994

INVENTOR(S) : Kurt P. Primeauz and
John M. Guidry

It is certified that error appears in the above-identified patent and that said Letters Patent is hereby corrected as shown below:

In Claim 3, column 3, lines 8-10 please delete "isolation tubing is then perforated and the second zone produced to depletion through said upper production assembly."

Signed and Sealed this

Twenty-seventh Day of September, 1994

*Attest:*

*Attesting Officer*

Bruce Lehman

BRUCE LEHMAN

*Commissioner of Patents and Trademarks*